US005957064A

United States Patent [19]

Barry et al.

[11] Patent Number: 5,957,064

[45] Date of Patent: Sep. 28, 1999

[54] METHOD AND APPARATUS FOR OPERATING A MULTIPLE HEARTH FURNACE

[76] Inventors: Louis T. Barry, 11 Pin Oak Rd., Skillman, N.J. 08558; Mark B. McCormick, 2 High Noon Rd., Weston, Conn. 06883

[21] Appl. No.: 08/980,476

[22] Filed: Nov. 28, 1997

[51] Int. Cl.[6] ..... F23N 5/18; F23G 5/04

[52] U.S. Cl. ..... 110/188; 110/185; 110/186; 110/190; 110/204; 110/206; 110/225; 110/227; 110/342; 110/345; 110/346

[58] Field of Search ..... 110/185, 186, 110/188, 190, 204, 205, 206, 207, 210, 215, 225, 227, 235, 247, 255, 258, 259, 346, 342, 344, 345, 348

[56] References Cited

U.S. PATENT DOCUMENTS

| | | | |
|---|---|---|---|
| 2,108,997 | 2/1938 | Schilling | 110/346 X |
| 2,110,309 | 3/1938 | Raisch | 110/346 X |
| 2,114,566 | 4/1938 | Lewers | 110/346 X |
| 2,116,058 | 5/1938 | Connolly | 110/346 X |
| 2,121,662 | 6/1938 | Hartley et al. | 110/346 X |
| 2,655,883 | 10/1953 | Martin | 110/346 X |
| 3,958,920 | 5/1976 | Anderson | 110/190 X |
| 3,968,756 | 7/1976 | Yamada | 110/342 X |
| 4,050,390 | 9/1977 | Hara et al. | 110/342 |
| 4,092,935 | 6/1978 | Barnabe | 110/346 X |
| 4,215,637 | 8/1980 | Lombana | 110/346 X |
| 4,248,164 | 2/1981 | Isheim | 110/346 X |
| 4,453,474 | 6/1984 | Lewis | 110/346 X |
| 4,901,654 | 2/1990 | Albertson et al. | 110/215 X |
| 5,080,025 | 1/1992 | Nell et al. | 110/346 X |

*Primary Examiner*—James C. Yeung
*Assistant Examiner*—Ljiljana V. Ciric
*Attorney, Agent, or Firm*—Kaplan&Gilman, LLP

[57] ABSTRACT

A multiple hearth furnace having a drying zone, a combustion zone and a cooling zone includes a recirculation loop that recycles exhaust gas from the drying zone to the cooling zone. In some embodiments, a first control loop including a temperature measurement device that measures temperature in the combustion zone controls fan speed of a recirculation fan that drives the recirculation loop. A second control loop monitors recirculation fan temperature and overrides the first control loop if the recirculation fan temperature exceeds a predetermined maximum. A third control loop controls air flow into the furnace.

14 Claims, 4 Drawing Sheets

METHOD AND APPARATUS FOR OPERATING A MULTIPLE HEARTH FURNACE

TECHNICAL FIELD

This invention relates to incineration, and more specifically, to a method and apparatus of controlling the incineration of sludge, slurry, and similar materials in multiple hearth furnaces such as those used in waste water treatment plants.

BACKGROUND OF THE INVENTION

The disposal of waste water sludge has become an increasingly difficult problem in recent years. With land fills becoming over filled, pressure from environmental groups mounting, and legislation directed at stopping ocean dumping, waste water from municipal sewage systems is often incinerated, thereby yielding inert ash material. By far, the overwhelming majority of such disposal is accomplished through the use of multiple hearth furnaces.

FIG. 1 shows a very high level conceptual block diagram of a conventional multiple hearth furnace 101 comprising eleven hearths 1 through 11. Hearths 1 through 11 are constructed to support the many pounds of sludge or other material to be incinerated. The sludge is fed in through an input port 119 and is thereby placed on the top of hearth 1. In some systems, the sludge may be fed through an opening to enter the second hearth instead of the top hearth, thereby allowing the top hearth to be used as an afterburner for emissions control. The remainder of the operation of multiple hearth furnace 101 serves to move the sludge to be incinerated through the hearths one through eleven until an inert ash to be disposed of exits the system through output port 114. The technique of causing the movement will be discussed later herein.

The eleven hearths shown in FIG. 1 are typically divided into three different major zones. These zones, from top to bottom, are termed the drying zone 120, the combustion zone 121 and the cooling zone 122. In the present example, the drying zone 120 comprises hearths 1 through 4 and is utilized to dry the sludge from a water content of approximately 70–85%, when the sludge is received through input port 119 in a typical waste water treatment plant, to a water content of approximately 45 to 65 percent by weight.

Once the sludge is dried enough to reach 45 to 65 percent liquid by weight, it is forced downwardly into the combustion zone 121 and combated. Most of the volatile material is combated in the upper hearths 5 and 6 of combustion zone 121, thereby producing temperatures in the range of approximately 1200 to 1900 degrees Fahrenheit. This removes most of the volatile portion of the combustible material and produces a material containing inert ashes and solid carbon residue. The lower hearths 7 and 8 are used to burn any remaining carbon. Thus, the combustion zone is sometimes considered two zones, an upper combustion zone for burning most of the volatile material in the sludge, and a lower combustion zone for incinerating the remaining carbon. In the present example, hearths 5 and 6 comprise the upper combustion zone, and hearths 7 and 8 comprise the lower combustion zone, thereby forming an entire combustion zone of four hearths.

After combustion, the sludge, now essentially all inert ash, reaches the lowest hearths 9 through 11 which make up the cooling zone 122, and exits from opening 114. The cooling zone includes air, sometimes forced in from outside of the system with a fan. The final product exiting from output port 114 is inert ash at a temperature of approximately 100° F.

FIG. 2 shows a typical arrangement of four arms 201 through 204 on central shaft 115. Each arm contains a plurality of rabble teeth 210.

During operation, the central shaft 115 rotates and the arms 201–204 move around the hearth, with rabble teeth 210 forcing the sludge toward the center of the hearth where it may be forced through opening 206 to the next hearth below. As can be appreciated from FIG. 1, some of the hearths include an opening 206 of FIG. 2 in the center of the hearth, while others include the openings 116 at the outer edge of the hearth, as shown in FIG. 1. The rabble teeth 210 for each hearth are tilted inwardly or outwardly in such a manner that causes the sludge to be forced towards the outside of the hearth for those hearths where the opening is at the outer edge of the hearth, and towards the inside of hearth for those hearths where the opening is towards the inside of the hearth as in FIG. 2.

In conventional multiple hearth furnaces such as that depicted in FIGS. 1 and 2 hereof, the temperature required for each of the zones is, for the most part, manually controlled. Specifically, air is injected into the combustion zone, usually through the cooling zone, in a quantity which is sufficient to supply the required oxygen for proper combustion. Additionally, auxiliary burners may be provided on the furnace in order to make up any heat deficient in the drying or combustion of the materials.

In recent furnaces however, due to higher capacity and dryer feed materials, additional excess air is often pumped into the combustion zone. The excess air is required to offset the hotter burning, increased capacity furnaces, and specifically, in order to appropriately limit the peak temperature thereof. The introduction of additional air into the combustion zone brings with it several disadvantages.

One such disadvantage is that the additional air results in the consumption of additional energy to power the larger fans required to power the exhaust gas cleaning equipment. In addition, the higher oxygen concentration that results from air being pumped into the combustion zone causes an increase in the presence of nitrogen oxides in the exhaust gas, as well as the formation of melted residual ash near the end of the combustion zone. Moreover, the increased flow of air often results in extinguished combustion in the carbon burning zone which results in incomplete combustion. As a result, metal sulfides may be present in the ash exiting the multiple hearth furnace. Finally, the additional air being forced through the combustion chamber also leads to a quenching effect which causes lumps of partially dried but unburned material called sludge balls to pass through the incinerator and present themselves at the ash disposal system.

It is an object of the invention to provide a technique for increasing the efficiency of multiple hearth furnaces.

It is another object of the invention to provide for automatic control and adjustment of air flows in multiple hearth furnaces using flue gas recirculation.

It is an object of the invention to increase the efficiency of multiple hearth furnaces without introducing so much oxygen into the combustion zone such that nitrogen oxide emissions are increased significantly.

It is another object of the invention to reduce the melted ash (i.e.; slag) formed as the sludge makes its way through the numerous hearths.

It is another object of the invention to increase the capacity of a multiple hearth furnace.

It is still a further object of the invention to provide a technique for reducing or eliminating the formation of sludge balls present in the material as it presents itself at the lower most hearths.

SUMMARY OF THE INVENTION

The above and other problems of the prior art are overcome and a technical advance is achieved in accordance with the teachings of the present invention which relates to a multiple hearth furnace using a novel technique of flue gas recirculation in order to provide for increased incineration efficiency as well as a variety of other benefits. In accordance with the teachings of the present invention, a fan is installed in such a manner as to recirculate flue gases from the drying zone, preferably at the top hearth thereof, to the cooling zone, preferably to the bottom hearth of the cooling zone. Additionally, a fan may be utilized to pump air into the combustion zone. The recirculation of gas from the drying zone to the cooling zone results in a slightly heated cooling zone. This results in increased combustion without introducing additional oxygen into the combustion zone and thus increasing the production of Nitrogen Oxides.

In an enhanced embodiment, a passive infrared detector (PAIR) is utilized to control the fan speed of the recirculation fan. Specifically, the fan speed utilized in removing gases from the drying zone and recirculating them to the cooling zone is adjusted based upon a feedback loop connecting such maximum speed adjustment to the output of the PAIR detector. As the temperature of the burning carbon increases, the fan speed, as controlled by the output of the PAIR detector, is increased. If the fan temperature increases too much, the fan may overheat. This problem is avoided by including an override such that increased fan temperature above a predetermined value results in decreased rotation speed, notwithstanding the aforementioned PAIR output.

Finally, external air is introduced into the feedback path in a sufficient quantity to properly regulate oxygen content. A detector measures oxygen in an upper hearth and opens or closes an air valve in response thereto. Overheating of the recirculation fan results in an override, thereby greatly opening the air valve and cooling the fan, irrespective of the aforementioned oxygen detector.

Additional benefits of the invention will be seen from an examination of the following description of the preferred embodiment and drawings.

DETAILED DESCRIPTION OF THE PREFERRED EMBODIMENT

Figure 1:
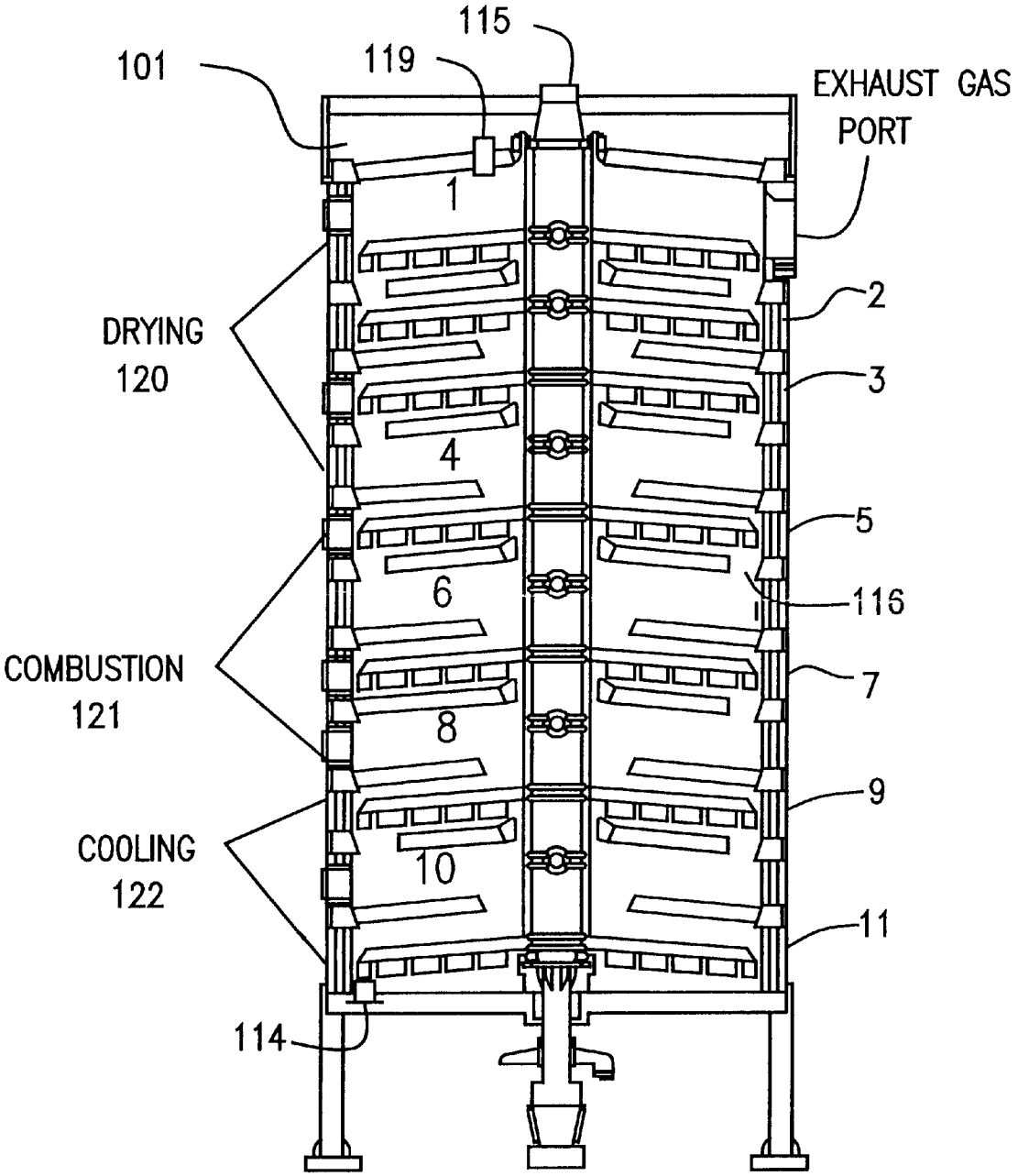
FIG. 1 shows a prior art multiple hearth furnace comprising eleven exemplary hearths.
Figure 2:
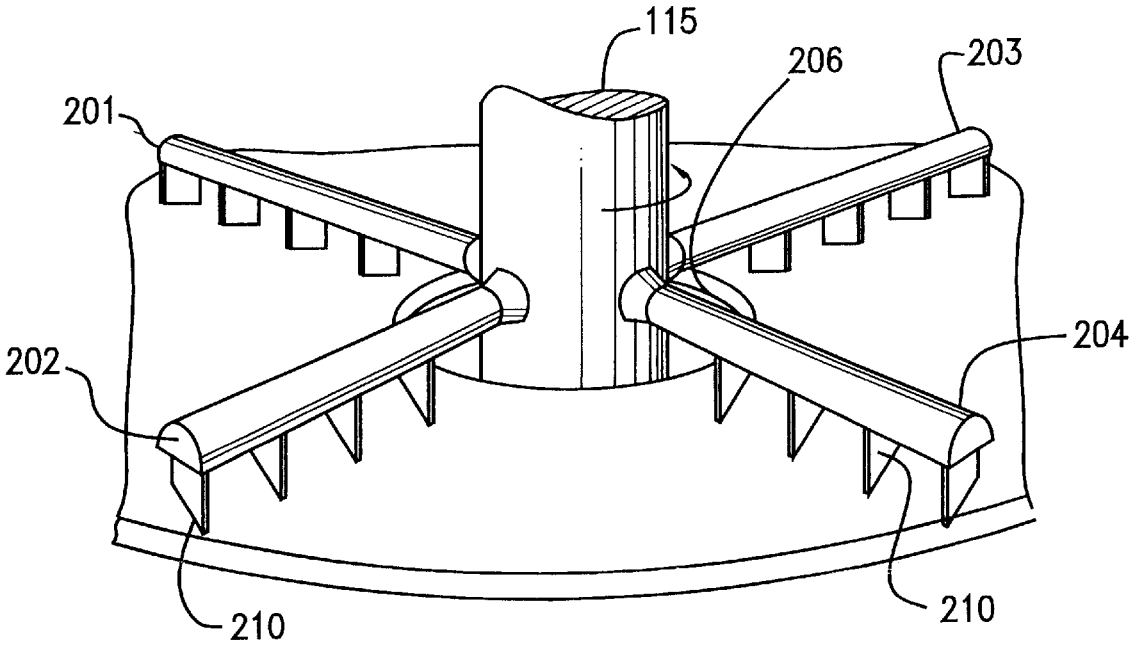
FIG. 2 depicts the rabble arms and rabble teeth of a multiple hearth furnace.
Figure 3:
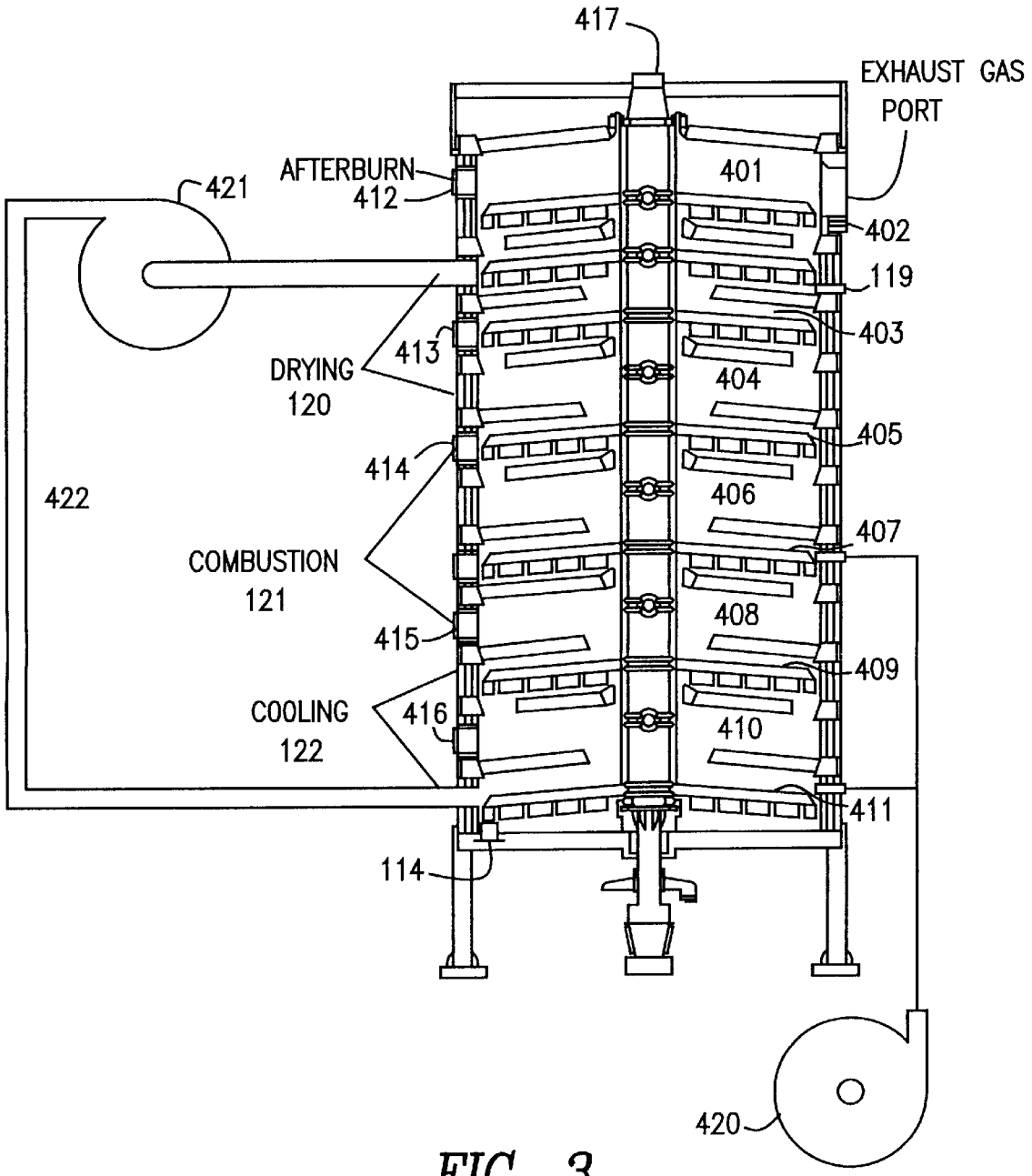
FIG. 3 is an exemplary embodiment of the present invention comprising a feedback path for recirculating flue gases from the drying zone to the cooling zone.

FIG. 3 shows a conceptual block diagram of the arrangement of the present invention comprising a plurality of hearths 401 to 411, several external burners 412 through 416, and a central shaft 417. Additionally, a fan 420 is shown as introducing additional air into the furnace often through multiple nozzles.

In operation, as the sludge material to be treated makes its way through the system from upper hearth 401 of the drying zone to lower hearth 411 of the cooling zone 122, flue gases recirculate via fan 421 and piping 422 in order to be returned to the cooling zone at lower hearth 411. Ideally, cooling zone 122 comprises three or four hearths, the combustion zone comprises three or four hearths, and the drying zone comprises three or four hearths.

Additionally, fan 421 should be arranged in order to provide sufficient power to force between 25 and 125 percent of the normal exhaust gas volume which would typically exit the drying zone 120 back into the cooling zone. Those of skill in this art will be familiar with how to select such a fan.

While forcing air from anywhere within the drying zone to the cooling zone results in improved performance, ideally the system operates by forcing air from the top hearth of the drying zone sometimes termed the feed hearth, to the lowest hearth of the cooling zone.

Additionally, it has been found that the recirculation fan 421 should provide enough force to recirculate approximately 25 percent to 125 percent of the normal exhaust gas volume which would exit the drying zone if no recirculation fan had been present. The recirculation may also provide that gas being recirculated is forced into a plurality of hearths, only one of which is the lower most hearth of the cooling zone. For example, gas may be recirculated from one hearth in the drying zone to plural hearths in the cooling zone, one of which is preferably the lower most hearth. Additionally, gas may be recirculated from plural hearths within the drying zone to one or more hearths within the cooling zone.

As an additional improvement, it may be desirable to adjust the amount of gas being recirculated based upon parameters such as the highest temperature within the combustion zone, which may include one or more hearths. Specifically, it has been found that a control loop with feedback may be utilized to allow adjustment of the volume of gas recirculated based upon the temperature of the combustion zone. An exemplary embodiment of such an arrangement will now be discussed.

Figure 4:
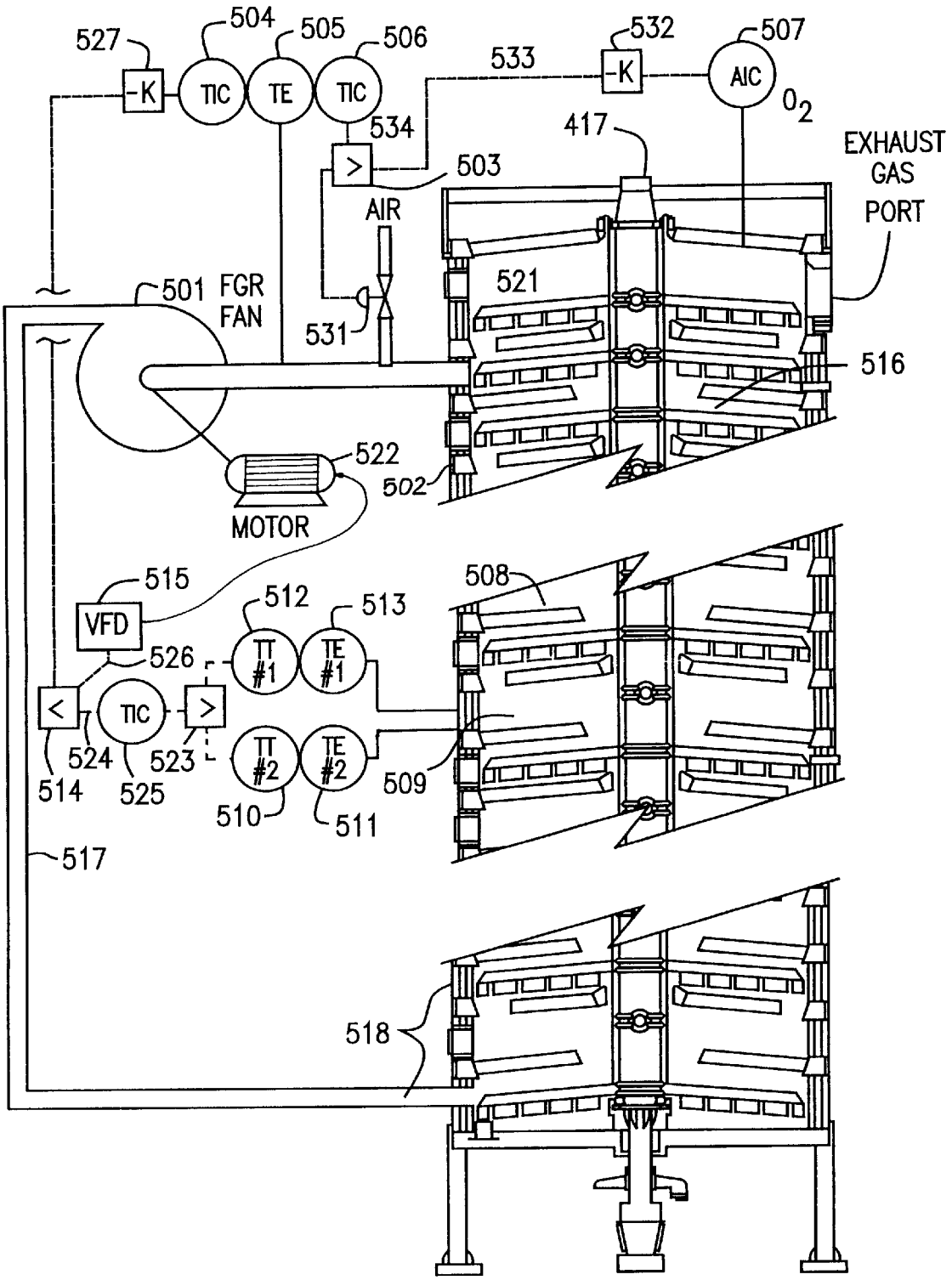
FIG. 4 shows the exemplary embodiment of FIG. 3 with the addition of a PAIR detector and control loop for adjusting the maximum fan speed of the fan being used to recirculate the flue gases as well as an additional control loop for regulating oxygen content.

FIG. 4 shows an exemplary embodiment of the present invention utilizing an enhanced control system for providing control of a flue gas recirculation fan 501. The arrangement of FIG. 4 includes a feed hearth 516 which is part of the drying zone. As indicated, path 517 depicts the flue gas recirculation path from the drying zone back to the cooling zone 518. Temperature elements 511, and 513 are preferably passive infrared (PAIR) detectors, well-known heat sensing devices for monitoring the temperature of the solid material on the hearth. Temperature element 505 is typically a thermocouple.

The arrangement also includes a temperature indicating controller 506, temperature transmitters 510 and 512, and variable frequency drive 515. An oxygen detector 507 is arranged to measure oxygen content at top hearth 521, which, in the example of FIG. 4, is an afterburner hearth. As indicated by the discontinuities, any number of hearths is possible.

In operation, FAR fan 501 begins operating with torque supplied by motor 522 and causes gases from feed hearth 516 in the drying zone to be sucked out and recirculated to the cooling zone 518, preferably the bottom hearth thereof as shown. The concept behind the control electronics indicated in FIG. 4 is to control the speed of the fan based upon the bed temperature detected at hearths 508 and 509, which represent the lower combustion zone where carbon is combusted as previously described.

Each of temperature elements 511 and 513 outputs a temperature signal and with the assistance of temperature transmitters 510 and 512, transmits a voltage or current indicative of such temperature to decision block 523. At decision block 523, the greater of the two temperatures is sent to a temperature indicator controller 525, which typically outputs a low voltage signal. The output 524 of temperature indicating controller 525 is therefore a voltage in the range of, for example, 0 to 5 volts. Temperature indicating controller 525 varies such voltage according to the difference between the predetermined set point and the hottest solids temperature of combustion hearths 508 or 509. This voltage is fed into decision block 514 and utilized to control the VFD 515 in order to increase the speed of the fan as the solids temperature in the hotter of hearths 508 and 509 rises. An exemplary set of parameters might be to increase the fan speed linearly between 500 RPM and 1350 RPM, as the hottest combustion hearth increases from 1400° F. to 1850° F. It is preferable to monitor at least two hearths, to be sure the maximum temperature is detected.

As the temperature of the solids in combustion zone 121 increases, so does the speed of revolution of fan 501. However, the hot fan presents a danger of mechanical failure. Thus, if the fan 501 itself begins to become overheated, then the speed of the fan should not be increased. In accordance with this goal, temperature element 505, which is typically a thermocouple, senses the temperature at the gas input of FGR fan 501 and with the assistance of a temperature indicator controller 504 and inverter 527, sends an inverted voltage signal to comparator 514. If the temperature of the fan becomes too hot, then comparator 514 will send input 526 as the control signal to VFD 515, thereby decreasing the speed of the fan.

Thus, the rotation speed of the fan is controlled in accordance with the maximum solids temperature being generated in combustion hearths 508 and 509 unless and until that heat becomes so hot that the increased revolution of the fan causes the fan to be at risk of mechanical damage or failure. In such a case, the fan temperature will take over as the controlling signal for fan revolution, thereby slowing down the speed of the fan.

An additional feedback loop is utilized to control an air valve 531 for supplying air from external to the system into the FGR path 517. Specifically, an oxygen detector 507 and inverter 532 are input into the comparator 503. The detector 507 is set to output a voltage in the range of 0 to 5 volts DC based upon the oxygen content present in the gas at the top of the highest hearth in multiple hearth furnace 502. Specifically, as the oxygen content measured by detector 507 increases above a predetermined set point, typically in the range of 3 to 8 volume percent, the inverter 532 will send a decreased signal to the comparator 503, which will normally send the decreased input 533 to a valve 531, thereby closing the valve slightly. Accordingly, as the oxygen content measured by detector 507 increases, the amount of air, and thus oxygen, allowed in from external to the system will decrease because valve 531 will close slightly. Conversely, as oxygen content measured by detector 507 decreases, the valve will open slightly, thereby increasing the input of oxygenated air into the system.

As an override, temperature indicating controller 506 is set to a predetermined maximum value of temperature permitted by the fan. For example, many stainless steel fans are limited to 1400 degrees Fahrenheit when their rpm reaches 1350. If the fan continues to overheat, then comparator 503 will receive a greater signal from input 534 than from 533. Accordingly, the air valve 531 will be forced open almost entirely when the temperature of the fan 501 becomes too hot. This forcing open of the air valve, and the flooding of the recirculation path with cool air from external to the system, occurs notwithstanding the oxygen content measured by detector 507.

Thus, while the oxygen content in the drying zone is normally used as the feedback parameter for adjusting valve opening, the valve opening is adjusted by high temperature sensor 506 if and when fan 501 overheats. In accordance with the foregoing techniques, a first parameter is therefore used to control the valve opening, until that parameter is no longer useful, after which a second parameter is used to control the valve opening.

While the above describes the preferred embodiment of the invention, various other modifications or additions which are apparent to those skilled in the art may be made. For example, while the temperature at the combustion zone has been utilized to control the feedback path between the drying zone and the cooling zone, the temperature at any zone may be utilized to control a feedback path between any other two zones. Additionally, while the specific parameters for control being utilized are fan temperature and oxygen content, any hierarchy of parameters may be utilized. Indeed, the feedback may be controlled by a plurality of different parameters in order to form a hierarchy. Parameter 1 may be utilized as long as certain conditions are met, in which case parameter 2 takes over as long as certain conditions are met. When those conditions are not met, a third parameter may take over as well.

The above describes the preferred embodiments of the invention, however, various other modifications will be apparent to those of ordinary skill in the art. It is intended that such modifications be covered by the appended claims.

We claim:

1. A multiple hearth furnace comprising:

a plurality of hearths arranged in superposed relation, at least a first of said hearths defining a drying zone, at least a second of said hearths defining a combustion zone, and at least a third of said hearths defining a cooling zone, wherein:

said drying zone is operable to dry material to be combusted;

said combustion zone is disposed beneath said drying zone and is operable to combust dried material received from said drying zone;

said cooling zone is disposed beneath said combustion zone and is operable to cool combusted material received from said combustion zone;

means for transferring said material sequentially from said first hearth defining said drying zone to said second hearth defining said combustion zone to said third hearth defining said cooling zone;

means for recirculating gases from the drying zone to the cooling zone.

2. Apparatus of claim 1 wherein:

said drying zone comprises an uppermost hearth and an underlying hearth;

said cooling zone comprises an overlying hearth and a lowermost hearth; and said means for recirculating includes means for recirculating gases from the uppermost hearth of the drying zone to the lowermost hearth in the cooling zone.

3. Apparatus of claim 1 further comprising a fan for pushing air into the combustion zone.

4. Apparatus of claim 3 wherein each of said cooling zone, said drying zone, and said combustion zone comprises a plurality of hearths.

5. Apparatus of claim 1 further comprising temperature measurement means operatively engaged to said combustion zone and operable to measure variations in temperature within the combustion zone.

6. Apparatus of claim 5 further comprising means for adjusting said recirculating means to change a volume of said gas being recirculated from said drying zone to said cooling zone in response to said variations in temperature within the combustion zone.

7. A multiple hearth furnace comprising:

a plurality of hearths, organized into at least first, second, and third superposed zones, for incinerating material that passes sequentially through said zones;

means for measuring a parameter present in said second zone; and means for adjusting feedback of flue gases between said first and said third zones based upon said parameter measure in said second zone.

8. The furnace of claim 7 wherein said parameter is temperature.

9. The furnace of claim 8 wherein said first zone is a drying zone, said second zone is a combustion zone, and said third zone is a cooling zone.

10. Apparatus for controlling a multiple hearth furnace wherein the hearths are divided into a plurality of zones, said apparatus comprising:

a recirculation path for moving gas between a first zone and a second zone of said multiple hearth furnace;

adjustable valve means for allowing an adjustable amount of air from external to said multiple hearth furnace to be mixed with gas being recirculated from said first zone to said second zone; and means for adjusting said valve means in response to a first parameter within at least one of said zones and a second parameter external to said multiple hearth furnace.

11. Apparatus of claim 10 wherein said first parameter is oxygen content in one of either a drying zone or afterburner hearth of said furnace and said second parameter is fan temperature.

12. Apparatus of claim 11 comprising:

means for utilizing the first parameter when the fan temperature is below a predetermined value; and means for utilizing the second parameter when the fan temperature equals or exceeds said predetermined value.

13. Apparatus for controlling a multiple hearth furnace, said multiple hearths arranged in superposed relation and defining a first zone that overlies a second zone that overlies a third zone, comprising:

means for recirculating flue gases from said first zone to said third zone;

control electronics for controlling said means for recirculating flue gases, wherein:

said control electronics control said means responsive to a temperature of said second zone when a first temperature of said means is below a predetermined value, and said control electronics control said means responsive to said first temperature when said first temperature equals or exceeds said predetermined value.

14. Apparatus of claim 13 further comprising means for controlling an amount of external air to be mixed with said flue gases being recirculated, wherein:

said means for controlling are responsive to oxygen content when said first temperature is below said predetermined value, and said means for controlling are responsive to said first temperature when said first temperature equals or exceeds said predetermined value.

* * * * *